US007261073B2

(12) United States Patent
Eisenhardt

(10) Patent No.: US 7,261,073 B2
(45) Date of Patent: Aug. 28, 2007

(54) VALVE DRIVE

(75) Inventor: Gunter Eisenhardt, Adelsdorf-Neuhaus (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/569,765

(22) PCT Filed: Jul. 20, 2004

(86) PCT No.: PCT/EP2004/008066

§ 371 (c)(1),
(2), (4) Date: Feb. 23, 2006

(87) PCT Pub. No.: WO2005/028816

PCT Pub. Date: Mar. 31, 2005

(65) Prior Publication Data

US 2007/0012272 A1 Jan. 18, 2007

(30) Foreign Application Priority Data

Sep. 5, 2003 (DE) ..... 103 40 944

(51) Int. Cl.
*F01L 1/34* (2006.01)

(52) U.S. Cl. ..... 123/90.16; 123/90.15; 123/90.39

(58) Field of Classification Search ..... 123/90.16, 123/90.15, 90.39, 90.43
See application file for complete search history.

(56) References Cited

U.S. PATENT DOCUMENTS 4,500,169 A 2/1985 Donnelly
4,682,575 A 7/1987 Simko
4,739,734 A 4/1988 Honda et al.
4,840,151 A * 6/1989 Sakata ..... 123/90.43
4,913,104 A 4/1990 Mills

FOREIGN PATENT DOCUMENTS

| | | |
|---|---|---|
| DE | 37 09 882 | 10/1987 |
| DE | 37 43 854 | 7/1989 |
| DE | 199 32 348 | 1/2001 |
| DE | 699 14 348 | 1/2001 |
| JP | 601 16 809 | 6/1985 |
| WO | WO 00/20730 | 4/2000 |

* cited by examiner

*Primary Examiner*—Zelalem Eshete
(74) *Attorney, Agent, or Firm*—Charles A. Muserlian

(57) ABSTRACT

The invention relates to a valve timing mechanism, in particular for four-cycle engines, having the following components:

- a rocker arm frame (2) which has two bars (34, 35) for accommodating rocker arms;
- hydraulic elements (6);
- a steel sheet part which is arranged between the hydraulic elements (6) and the rocker arm frame (2);
- a pressurized oil line;
- deep-drawn steel sheet rocker arms (1) which are configured uniformly, having a U-shaped cross section, a cylindrical roller, a cap (4) for a supporting ball (5) of the hydraulic element (6), and having contact elements for the valve stems of the inlet and outlet valves.

According to the invention, the manufacturing costs of the steel sheet rocker arms are reduced by the fact that the outer pistons (9) of the hydraulic elements (6) are guided in blind bores (8) of the rocker arm frame (2), and by the fact that a steel disk (11) is arranged at the bottom of the blind bores (8) as a stop for the inner piston (10).

10 Claims, 2 Drawing Sheets

VALVE DRIVE

This application is a 371 of PCT EP 2004/008066 filed Jul. 20, 2004.

FIELD OF THE INVENTION

The invention relates to a valve timing mechanism for four-cycle engines, having the following components:

- a rocker arm frame (2) which is configured in one piece from lightweight metal and has two bars (34, 35) which are connected by webs (36, 37) for accomodating rocker arms;
- hydraulic elements (6) for valve clearance compensation which have an outer piston (9) which is open on one side and has a supporting ball (5) which is configured in one piece at the closed end of said outer piston (9), and an inner piston (10) which is open on one side, is guided in the outer piston (9) and is connected in flow terms via a spring-loaded ball valve (12) to a high-pressure space (13) of said outer piston (9);
- a steel sheet part which is arranged between the hydraulic elements (6) and the rocker arm frame (2);
- a pressurized oil line which is arranged in the longitudinal extent of the rocker arm frame
- (2) at the level of the open end of the hydraulic elements (6);
- deep-drawn steel sheet rocker arms (1) which are configured uniformly for all the valves, having a U-shaped cross section and having cylindrical rollers (3) mounted on needle bearings for at least one camshaft, and having a cap (4) for the supporting ball (5), and having contact elements for the valve stems of the inlet and outlet valves.

BACKGROUND OF THE INVENTION

In four-cycle engines having four valves, it is customary to use rocker arms to actuate the valves, which rocker arms are mounted on a common rocker arm shaft. Different rocker arms are thereby required on account of the different position of the valves.

In addition, hydraulic clearance compensation elements which are arranged at the valve-side end of the rocker arms increase its polar moment of inertia. As a result, strengthened valve springs are thereby required which result in a stiffening and possible hardening of the rocker arm shaft.

Moreover, the hydraulic clearance compensation elements which are installed in the rocker arm require a complex pressurized oil supply means having fully machined pressurized oil lines. All the above measures cause great manufacturing expenditure.

The PCT application WO 00/20730 describes a valve timing mechanism for four-cycle engines which is improved compared with the above-described prior art and has the following components:

- a rocker arm frame which is configured in one piece from lightweight metal and has two bars which are connected by webs, for accommodating the rocker arms;
- hydraulic elements for valve clearance compensation which have an outer piston which is open on one side and has a supporting ball which is configured in one piece at the closed end of said outer piston, and an inner piston which is open on one side, is guided in the outer piston and is connected in flow terms via a spring-loaded ball valve to a high-pressure space of said outer piston;

- a steel sheet part which is arranged between the hydraulic element and the rocker arm frame.;
- a pressurized oil line which is arranged in the longitudinal extent of the rocker arm frame at the level of the open end of the hydraulic elements;
- deep-drawn steel sheet rocker arms which are configured uniformly for all the valves, having a U-shaped cross section and having cylindrical rollers mounted on needle bearings for at least one camshaft, and having a cap for the supporting ball, and having contact elements for the valve stems of the inlet and outlet valves.

Despite the improvements which are achieved by the above components, numerous requirements with regard to low manufacturing and assembly costs are still not met.

OBJECT OF THE INVENTION

The invention is therefore based on the object of providing a valve timing mechanism for four-cycle engines having preferably four valves per cylinder, which valve timing mechanism is distinguished by inexpensive manufacturing and assembly.

SUMMARY OF THE INVENTION

According to the invention, the object is achieved by a valve timing mechanism, for four cycle engines, having the following components:

- a rocker arm frame (2) which is configured in one piece from lightweight metal and has two bars (34, 35) which are connected by webs (36, 37) for accomodating rocker arms;
- hydraulic elements (6) for valve clearance compensation which have an outer piston (9) which is open on one side and has a supporting ball (5) which is configured in one piece at the closed end of said outer piston (9), and an inner piston (10) which is open on one side, is guided in the outer piston (9) and is connected in flow terms via a spring-loaded ball valve (12) to a high-pressure space (13) of sald outer piston (9);
- a steel sheet part which is arranged between the hydraulic elements (6) and the rocker arm frame (2);
- a pressurized oil line which is arranged in the longitudinal extent of the rocker arm frame (2) at the level of the open end of the hydraulic elements (6);
- deep-drawn steel sheet rocker arms (1) which are configured uniformly for all the valves, having a U-shaped cross section and having cylindrical rollers (3) mounted on needle bearings for at least one camshaft, and having a cap (4) for the supporting ball (5), and having contact elements for the valve stems of the inlet and outlet valves, wherein the outer pistons (9) of the hydraulic elements (6) are guided in blind bores (8) of the rocker arm frame (2), and in that a steel disk (11) is arranged at the bottom of the blind bores (8) as a stop for the inner piston (10).

An optimum pair of sliding elements is attained and the steel guide bushes used in the prior art can be omitted in a cost-saving manner as a result of the fact that the outer pistons of the hydraulic elements are guided directly in blind bores of the lightweight metal rocker arm frame.

The steel disk which is arranged at the bottom of the blind bore serves, inter alia, as a stop for the inner piston of the hydraulic element and thus prevents the wear which is possible there of the rocker arm frame.

It is advantageous that the diameter of the steel disks preferably corresponds to that of the blind bores, and that the pressurized oil line is configured as a pressurized oil bore, the center line of which is preferably tangent on the circumference of the center plane of the steel disks of the hydraulic elements which are arranged in an offset manner.

In modern diesel engines, the valves are arranged in a twisted manner about the cylinder axis. As a result, the swirl channels can be positioned more satisfactorily. This valve position results in an offset of the respectively adjacent steel sheet rocker arms and their hydraulic elements. As a result of the position according to the invention of the pressurized oil bore, the steel disks of the offset hydraulic elements have pressurized oil applied uniformly to their sides which are close to the bottom and remote from the bottom, and their functioning is thus ensured. However, applications are also conceivable, in which a higher or a lower position of the pressurized oil bore is advantageous.

Preferably radially arranged, matching channels which connect the pressurized oil bore to venting bores and to inner spaces of the inner pistons serve on the upper side and lower side of the steel disks for the functional reliability of the hydraulic elements.

The air in the pressurized oil which collects in the upper region of the pressurized oil bore is discharged to the venting bores which are preferably arranged in the center line of the hydraulic elements in the rocker arm frame with a low oil leakage flow through the channels which are arranged on the upper side of the disks. The pressurized oil from the lower region of the pressurized oil bores which is low in air passes via the channels of the lower side of the steel disks into the inner space of the inner pistons, from where it flows into a high-pressure space of the outer piston via a spring-loaded ball valve during compensation of the valve clearance.

It is advantageous that the outer side of the inner pistons has a first circumferential groove in the overlap region with the inner side of the outer pistons, said first circumferential groove being connected to the inner space of the inner pistons via a radial bore. In this way, the leakage oil which is low in air from the high-pressure space of the outer pistons is collected in the circumferential groove of the inner pistons and is returned via the radial bore into the inner space of the inner pistons.

It is also advantageous that, on the outer circumference of the outer pistons in the region of their open end, a second circumferential groove is arranged with a circlip which latches into a third circumferential groove in the end region of the blind bores. As a result, that outer piston of the hydraulic elements which is connected to the steel sheet rocker arm is latched to the rocker arm frame. In this way, the rocker arm frame with all the rocker arms which are fastened to it is a preassembled unit which can be handled easily.

It is necessary for the adjusting function of the hydraulic elements that the length of the third circumferential groove corresponds at least to the adjustment path of the hydraulic elements.

It has proven advantageous that the cross section of the deep-drawn steel sheet rocker arm is configured as a U-profile which is open at the top and has a profile bottom into which the cap is embossed, and that a cylindrical shaped-out molding having a minimum transverse camber is provided as a contact element for the valve stems at the valve-side end of the steel sheet rocker arms on the outer side of the profile bottom, the center line of said cylindrical shaped-out molding lying parallel to the tilting axis of the steel sheet rocker arm.

Most of the hydraulic element is located in the upwardly open U-profile of the steel sheet rocker arm. In addition to the cap, the cylindrical shaped moldings having the minimum transverse camber and the guide rails are formed in the profile bottom without additional outlay on manufacturing and installation space. The result is a considerable saving in overall height and design costs in comparison with the U-profile which is specified in the prior art and is closed at the top. Moreover, a low polar moment of inertia of the steel sheet rocker arm about its tilting axis is achieved, and simple lateral guidance of said steel sheet rocker arm by the guide rails which are guided on the valve stems is attained.

One alternative to the guide rails consists in extended side walls which are bent downward and backward and are welded to the profile bottom.

BRIEF DESCRIPTION OF THE DRAWINGS

Further features of the invention result from the following description and the drawings, in which an exemplary embodiment of the invention is shown diagrammatically and in which.

DETAILED DESCRIPTION OF THE DRAWINGS

Figure 1:
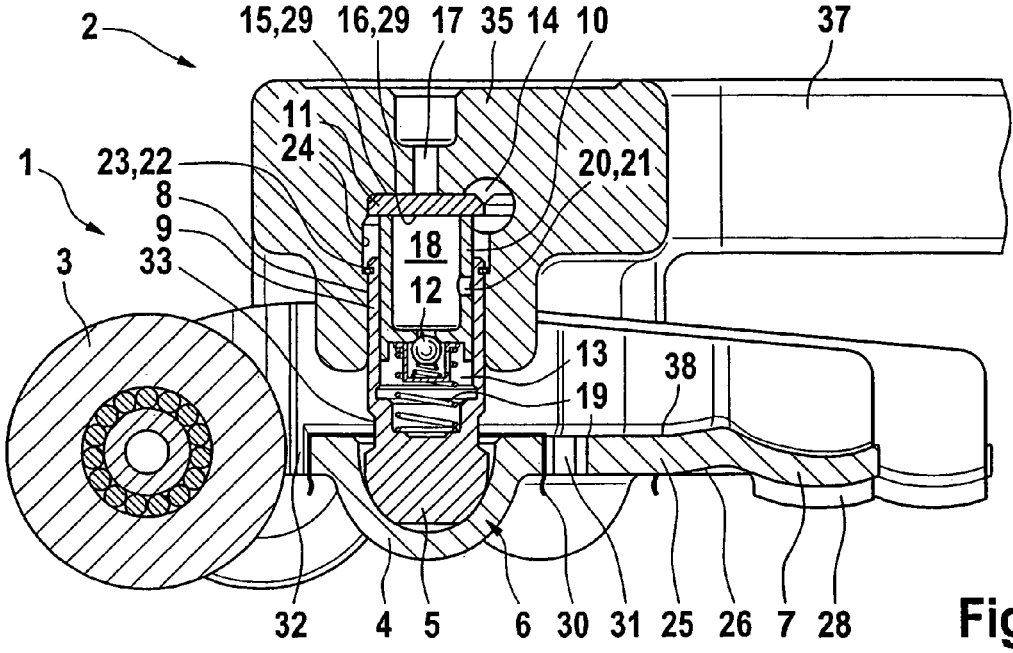
FIG. 1 shows a partial cross section A-A from FIG. 2 through a steel sheet rocker arm according to the invention which is fastened to a rocker arm frame.

FIG. 1 shows a longitudinal section A-A (cf. FIG. 2) through a steel sheet rocker arm 1 which is coupled to a rocker arm frame 2.

The steel sheet rocker arm 1 is configured as a two-armed lever. It is driven by a camshaft (not shown), via a cylindrical roller 3 which is mounted on needle bearings, is supported on the rocker arm frame 2 via a cap 4 and a supporting ball 5 of a hydraulic element 6 and acts on the valve stems (likewise not shown) via a cylindrical shaped-out molding 7 having a minimum transverse camber.

The hydraulic elements 6 serve for valve clearance compensation. They are guided in blind bores 8 in the lightweight metal of the rocker arm frame 2.

The hydraulic elements 6 have a hollow-cylindrical outer piston 9 which is open on one side, is made from steel and the closed end of which is formed in one piece with the supporting ball 5. A steel inner piston 10 is guided with sealing play in the interior of the outer piston 9, the open end of said steel inner piston 10 being supported on a steel disk 11 on the bottom of the blind bore 8, and the closed end of said steel inner piston 10 being connected in flow terms to a high-pressure space 13 of the outer piston 9 via a spring-loaded ball valve 12 which is arranged there.

The hydraulic elements 6 are supplied with pressurized oil via a pressurized oil bore 14 which extends in the longitudinal direction of the rocker arm frame 2 and the center line of which is tangent on the circumference of the center plane of the steel disks 11. The side 15 of the steel disks 11 which is close to the bottom and the side 16 of the steel disks 11 which is remote from the bottom are supplied with pressurized oil on account of this position of the pressurized oil bore 14.

Fine radial channels 29 (not shown) are arranged on both sides 15, 16 of the steel disks 11. The channels 29 of the side 15 which is close to the bottom guide pressurized oil which contains air and has collected in the upper region of the pressurized oil bores 14 to a venting bore 17 which is arranged in the center line of the blind bore 8, starts from the bottom of the latter and opens into the valve timing mechanism space.

The channels 29 on that side 16 of the steel disk 11 which is remote from the bottom serve to supply an inner space 18 of the inner piston 10 with pressurized oil which is largely free of air from the lower region of the pressurized oil bore 14. In the case of closed inlet and outlet valves during the valve clearance compensation by the force of a compression spring 19 which is arranged in the high-pressure space 13, the outer piston 9 sucks pressurized oil out of the inner space 18 via the ball valve 12 into the high-pressure space 13. This pressurized oil is highly pressurized as a result of the actuating forces during valve opening and flows into the sealing gap between outer and inner pistons 9, 10. From there, this oil which is low in air passes via a first circumferential groove 20 of the inner piston 10 which is arranged in the overlap region of the two pistons 10, 11 through a radial bore 21 situated in this groove back into the inner space 18, from where it is sucked into the high-pressure space 13 again.

The outer piston 9 has a second circumferential groove 22 on the outer circumference in the region of the open end, in which second circumferential groove 22 a circlip 23 is situated. The latter latches into a third groove 24 which is machined into the blind bore 8 in the region of that end of the latter which is close to the bottom. This produces a partially form-fitting and partially force-transmitting connection between the rocker arm frame 2 and the hydraulic element 6, which connection prevents the hydraulic element 6 from falling out of said rocker arm frame 2 and, as a result, makes simple assembly of the valve timing mechanism possible.

The level of the third groove 24 corresponds to the maximum adjustment path of the hydraulic element 6. At the same time, it serves to distribute the pressurized oil over the circumference of the hydraulic elements 6 and the steel disks 11.

The steel sheet rocker arm 1 is configured as a deep-drawn U-profile which is open at the top and has a profile bottom 25. The cap 4 for the supporting ball 5 is embossed into the profile bottom 25 and is part of the latter.

The inner side of the cap 4 is designed as what is known as a gothic profile which has a plurality of radii which merge into one another and offers a maximum contact surface area for the supporting ball 5.

The contact with the valve stems is ensured by a cylindrical shaped-out molding 27 having low transverse camber of the outer side 26 of the profile bottom 25 at the valve-side end of the steel sheet rocker arm 1. Here, the center line of the cylindrical shaped-out molding 27 is arranged parallel to the tilting axis of the steel sheet rocker arm 1. In conjunction with the cylindrical rollers which run on the camshaft and the caps 4 which adjust around the supporting balls 5 freely, the low transverse camber of the cylindrical shaped-out moldings 27 allows a movement of the steel sheet rocker arm 1 about its longitudinal axis, which movement compensates for all positional tolerances of the valve timing mechanism.

Two parallel guide rails 28 are formed in one piece with a rectangular cross section and at the distance of the diameter of the valve stems and in the tilting direction of the steel sheet rocker arms 1 on the outer side 26 of the profile bottom 25 in the region of the cylindrical shaped-out moldings 27 in a manner which follows their contour. As a result, simple and effective lateral guidance of the steel sheet rocker arms 1 is ensured via the valve stems.

The hydraulic elements 6 which are latched in the rocker arm frame 2 are connected captively to the steel sheet rocker arm 1 by holding clips 30 which latch both into openings 31, 32 in the profile bottom 25 and into a fourth circumferential groove 33 at the transition from the supporting ball 5 to the outer piston 9. This results in a unit comprising rocker arm frame 2 and steel sheet rocker arms 1 which is easy to mount.

As is evident from all the figures, the steel sheet rocker arms 1 are arranged offset in accordance with the position of the valves but are of identical design. Compared with the rollers 3, the camshafts (not shown) are positioned at half the lateral offset of the steel sheet rocker arms 1.

Figure 2:
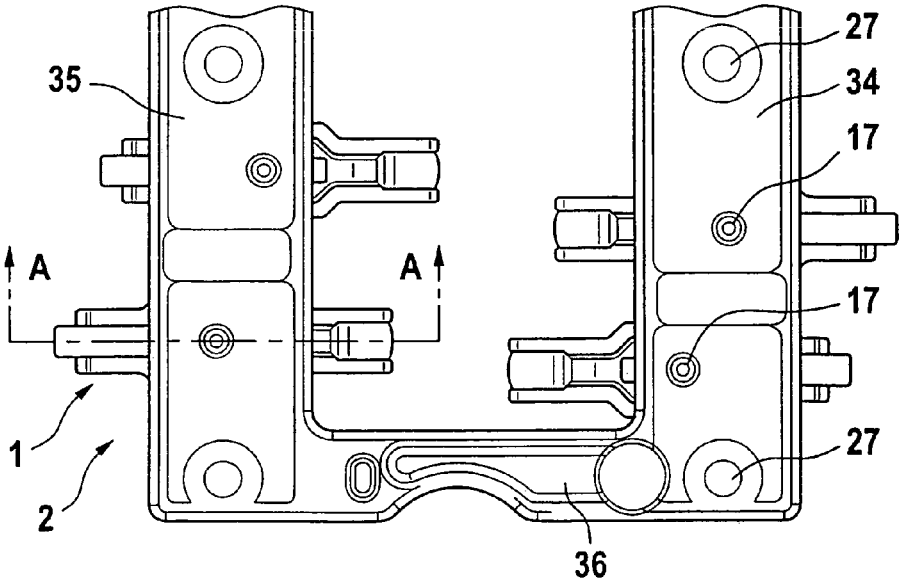
FIG. 2 shows a plan view of a part of the rocker arm frame from FIG. 1 with the steel sheet rocker arm coupled to it.

FIG. 2 shows a plan view of a part of the rocker arm frame 2 with coupled steel sheet rocker arms 1 and an indication of the position of the sectional plane A-A. The first and second bars 34, 35 are connected in one piece by a first web 36. The screw positions 27 of the screws for fastening the rocker arm frame 2 on the cylinder head and the venting bores 17 are also shown. The longitudinal and lateral offset of the steel sheet rocker arms 1 can be seen clearly.

Figure 3:
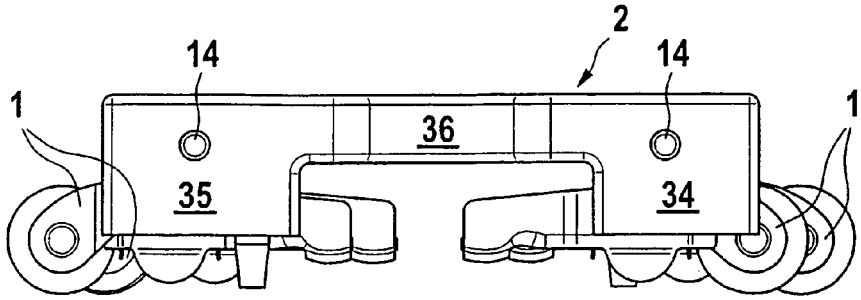
FIG. 3 shows a front view of the rocker arm frame with coupled steel sheet rocker arms.

FIG. 3 shows a front view of the rocker arm frame 2 with coupled steel sheet rocker arms 1. In addition to the view of the first and second bars 34, 35 and the first web 36 which connects them, the closed pressurized oil bores 14 can be seen.

Figure 4:
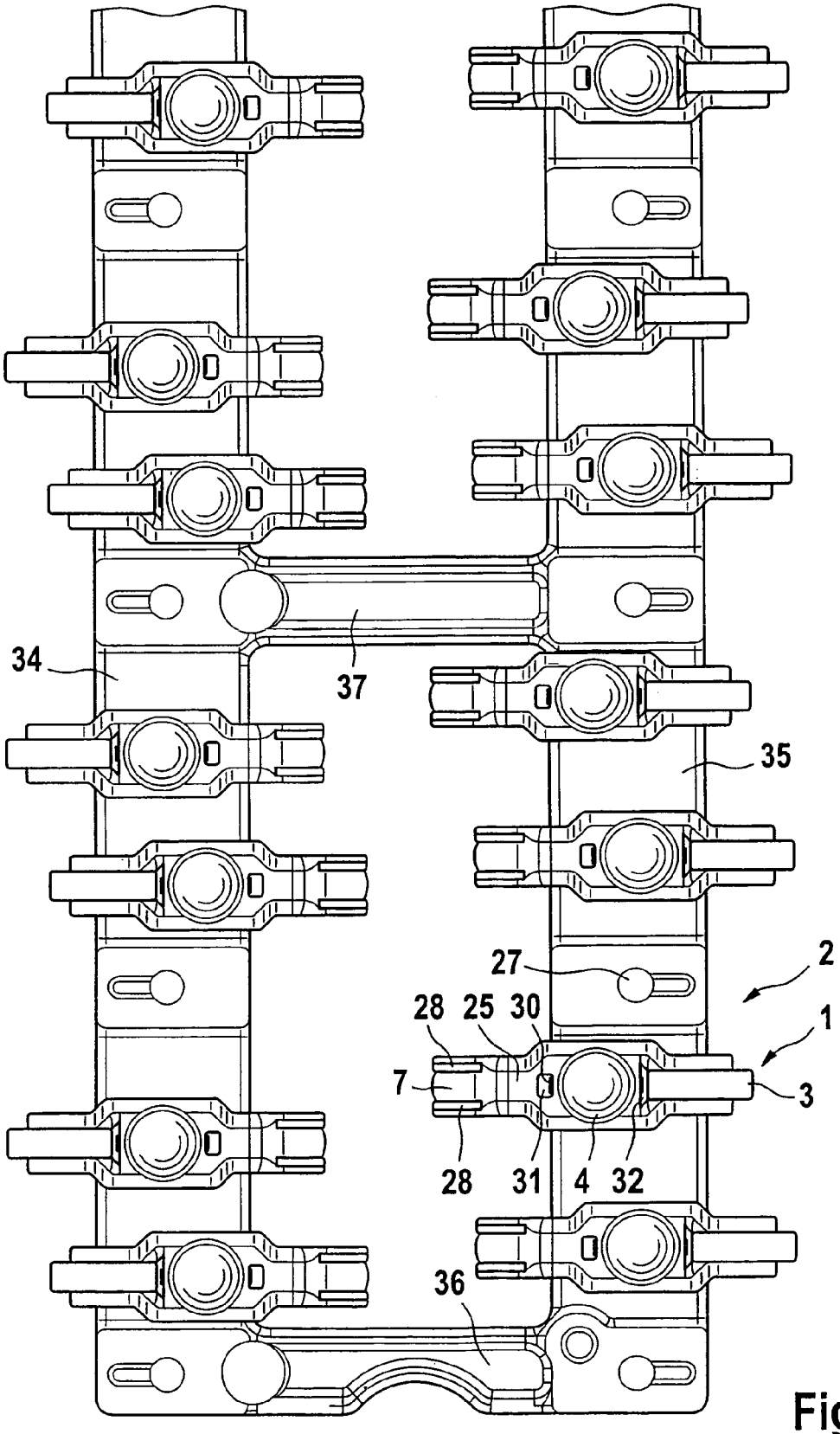
FIG. 4 shows a partial view of the lower side of the rocker arm frame with coupled steel sheet rocker arms.

FIG. 4 shows a partial view of the lower side of the rocker arm frame 2 with coupled steel sheet rocker arms 1. In addition to the first and second bars 34, 35, the first and second webs 36, 37 and the screw positions 27 of the screws required for screwing to the cylinder head are shown.

The bottom view of the steel sheet rocker arm 1 shows the cylindrical roller 3 and the outer view of the cap 4 which, just like the cylindrical shaped-out molding 7 and the guide rails 28, will be formed by plastic deformation of the profile bottom 25.

The holding clips 30 are latched into the openings 31, 32, which holding clips 30 serve on the upper side of the steel sheet rocker arm 1 to connect it to the hydraulic element 6 which in turn is connected to the rocker arm frame 2 by the circlip 23.

The solution according to the invention is distinguished by the following advantages:

- a pressure-resistant and thus functionally appropriate hydraulic element 6 by means of venting the pressurized oil before it flows into the inner space 18 of the inner piston 10 and returning the high-pressure leakage oil flow which is low in air to the inner piston 10;
- the hydraulic elements 6 are connected captively to the rocker arm frame 2 by circlips 23 and to the steel sheet rocker arms 1 by holding clips 30, the result of which is simple assembly of the precompleted rocker arm frame 2;
- low manufacturing costs, high strength with low weight and a low rotational moment of inertia are achieved by chipless manufacturing of the steel sheet rocker arms 1 in one piece;
- most of the hydraulic element 6 is located in the upwardly open U-profile of the steel sheet rocker arm 1. In addition to the cap 4, the spherical or cylindrical shaped moldings 7 including the guide rails 28 are formed in the profile bottom 25 without additional outlay on manufacturing and installation space. The result is a considerable saving in overall height and design costs in comparison with a U-profile which is closed at the top. Moreover, a low polar moment of inertia of the steel sheet rocker arm 1 about its tilting axis is achieved, and simple lateral guidance of said steel sheet rocker arm 1 by the valve stems is attained.

LIST OF DESIGNATIONS

1 Steel sheet rocker arm
2 Rocker arm frame
3 Roller
4 Cap
5 Supporting ball
6 Hydraulic element
7 Cylindrical shaped-out molding
8 Blind bore
9 Outer piston
10 Inner piston
11 Steel disk
12 Spring-loaded ball valve
13 High-pressure space
14 Pressurized oil bore
15 Side of the steel disk which is close to the bottom
16 Side of the steel disk which is remote from the bottom
17 Venting bore
18 Inner space
19 Compression spring
20 First circumferential groove
21 Radial bore
22 Second circumferential groove
23 Circlip
24 Third circumferential groove
25 Profile bottom
26 Outer side
27 Screw position
28 Guide rail
29 Channel
30 Holding clip
31 First opening
32 Second opening
33 Fourth circumferential groove
34 First bar
35 Second bar
36 First web
37 Second web
38 Inner side

The invention claimed is:

1. A valve timing mechanism, for four-cycle engines, having the following components:

a rocker frame which is configured in one piece from lightweight metal and has at least one bar which is connected by webs, for accomodating rocker arms;

hydraulic elements for valve clearance compensation which have an outer piston which is open on one side and has a supporting ball which is configured in one piece at the closed end of said outer piston, and an inner piston which is open on one side, is guided in the outer piston and is connected in flow terms via a spring-loaded ball valve to a high-pressure space of said outer piston;

a steel sheet part which is arranged between the hydraulic elements and the rocker arm frame;

a pressurized oil line which is arranged in the longitudinal extent of the rocker arm frame at the level of the open end of the hydraulic elements;

deep-drawn steel sheet rocker arms which are configured uniformly for all the valves, having a U-shaped cross section and having cylindrical rollers mounted on needle bearings for at least one camshaft, and having a cap for the supporting ball, and having contact elements for the valve stems of the inlet and outlet valves, wherein the outer pistons of the hydraulic elements are guided in blind bores of the rocker arm frame, and in that the steel part is designed as a steel disk arranged at the bottom of the blind bores as a stop for the inner piston and outer pistons are guided directly in blind bores of the light weight frame.

2. A valve timing mechanism, for four-cycle engines, having the following components:

a rocker frame which is configured in one piece from lightweight metal and has at least one bar which is connected by webs, for accomodating rocker arms;

hydraulic elements for valve clearance compensation which have an outer piston which is open on one side and has a supporting ball which is configured in one piece at the closed end of said outer piston, and an inner piston which is open on one side, is guided in the outer piston and is connected in flow terms via a spring-loaded ball valve to a high-pressure space of said outer piston;

a steel sheet part which is arranged between the hydraulic elements and the rocker arm frame;

a pressurized oil line which is arranged in the longitudinal extent of the rocker arm frame at the level of the open end of the hydraulic elements;

deep-drawn steel sheet rocker arms which are configured uniformly for all the valves, having a U-shaped cross section and having cylindrical rollers mounted on needle bearings for at least one camshaft, and having a cap for the supporting-ball, and having contact elements for the valve stems of the inlet and outlet valves, wherein the outer pistons of the hydraulic elements are guided in blind bores of the rocker arm frame, and in that the steel part is designed as a steel disk arranged at the bottom of the blind bores as a stop for the inner piston and outer pistons are guided directly in blind bores of the light weight frame, the diameter of the steel disks corresponds to that of the blind bores, and in that the pressurized oil line is configured as a pressurized oil bore, the center line of which is preferably tangent on the circumference of the center plane of the steel disks of the hydraulic elements which are arranged in an offset manner.

3. A valve timing mechanism, for four-cycle engines, having the following components:

a rocker frame which is configured in one piece from lightweight metal and has at least one bar which is connected by webs, for accomodating rocker arms;

hydraulic elements for valve clearance compensation which have an outer piston which is open on one side and has a supporting ball which is configured in one piece at the closed end of said outer piston, and an inner piston which is open on one side, is guided in the outer piston and is connected in flow terms via a spring-loaded ball valve to a high-pressure space of said outer piston;

a steel sheet part which is arranged between the hydraulic elements and the rocker arm frame;

a pressurized oil line which is arranged in the longitudinal extent of the rocker arm frame at the level of the open end of the hydraulic elements;

deep-drawn steel sheet rocker arms which are configured uniformly for all the valves, having a U-shaped cross section and having cylindrical rollers mounted on needle bearings for at least one camshaft, and having a cap for the supporting-ball, and having contact elements for the valve stems of the inlet and outlet valves, wherein the outer pistons of the hydraulic elements are guided in blind bores of the rocker arm frame, and in that the steel part is designed as a steel disk arranged at the bottom of the blind bores as a stop for the inner piston and outer pistons are guided directly in blind bores of the light weight frame, on those sides of the steel disks of the steel disks which are close to and remote from the bottom, matching, preferably radial channels are arranged which serve to connect the pressurized oil bore to venting bores and to the inner space of the inner pistons.

4. The valve timing mechanism of claim 3, wherein the venting bores in the rocker arm frame are arranged in the center line of the hydraulic elements.

5. The valve timing mechanism of claim 4, wherein the outer side of the inner pistons has a first circumferential groove in the overlap region with the inner side of the outer psitons, said first circumferential groove being connected to the inner space of the inner pistons via a radial bore.

6. The valve timing mechanism of claim 5, wherein the outer circumference of the outer pistons in the region of their open end, a second circumferential groove is arranged with a circlip which latches into a third circumferential groove in the end region of the blind bores.

7. The valve timing mechanism of claim 6, wherein the length of the third circumferential groove corresponds at least to the adjustment path of the hydraulic elements.

8. The valve timing mechanism of claim 7, wherein the cross section of the deep-drawn steel sheet rocker arm is configured as a U-profile which is open at the top and has a profile bottom into which the cap is embossed.

9. The valve timing mechanism of claim 8, wherein a cylindrical shaped-out molding having a minimum transverse camber is provided as a contact element for the valve stems at the valve-side end of the steel sheet rocker arms on the outer side of the profile bottom, the center line of said cylindrical shaped-out molding, lying parallel to the tilting axis of the steel sheet rocker arm.

10. The valve timing mechanism of claim 9, wherein two parallel guide rails are formed in one piece with a rectangular cross section and at the distance of the diameter of the valve stems and in the tilting direction of the steel sheet rocker arms on the outer side of the profile bottom in the region of the cylindrical shaped-out molding in a manner which follows its contour lying parallel to the tilting axis of the steel sheet rocker arm.

* * * * *